US009124989B2

(12) United States Patent
Medina

(10) Patent No.: US 9,124,989 B2
(45) Date of Patent: Sep. 1, 2015

(54) HEARING AID SLEEVE

(71) Applicant: Abraham Medina, Hurst, TX (US)

(72) Inventor: Abraham Medina, Hurst, TX (US)

( * ) Notice: Subject to any disclaimer, the term of this patent is extended or adjusted under 35 U.S.C. 154(b) by 0 days.

(21) Appl. No.: 14/207,520

(22) Filed: Mar. 12, 2014

(65) Prior Publication Data

US 2014/0341409 A1 Nov. 20, 2014

Related U.S. Application Data

(60) Provisional application No. 61/855,623, filed on May 20, 2013, provisional application No. 61/963,695, filed on Dec. 12, 2013.

(51) Int. Cl.
*H04R 25/00* (2006.01)

(52) U.S. Cl.
CPC ..... *H04R 25/456* (2013.01); *H04R 25/65* (2013.01)

(58) Field of Classification Search
CPC ..... H04R 29/00; H04R 25/02; H04R 25/00
USPC ..... 381/312, 328, 60, 322
See application file for complete search history.

(56) References Cited

U.S. PATENT DOCUMENTS

| | | | | |
|---|---|---|---|---|
| 5,654,530 | A * | 8/1997 | Sauer et al. | 181/130 |
| 2009/0052709 | A1* | 2/2009 | Smith | 381/328 |
| 2010/0166239 | A1* | 7/2010 | Bilderback | 381/322 |

* cited by examiner

*Primary Examiner* — Curtis Kuntz
*Assistant Examiner* — Julie X Dang
(74) *Attorney, Agent, or Firm* — Law Office of Jeff Williams; J. Oliver Williams

(57) ABSTRACT

A hearing aid sleeve is made from a pliable and flexible rubber material. The sleeve is configured to minimize acoustic feedback in an ear canal by restricting movement of a hearing aid relative to the ear canal. The hearing aid sleeve includes a pliable rubber body configured to flex to the contours of an ear canal, the rubber body having an outer surface. The opposing ends of the sleeve form a tapered contour. An aperture passes from a first end to a second end. The aperture is configured to accept contact with the hearing aid. The outer surface of the body is configured to flex to the contour of the ear canal and grip the surface of the ear canal, thereby increasing the compressive forces around the hearing aid sufficient to minimize acoustic feedback.

12 Claims, 1 Drawing Sheet

HEARING AID SLEEVE

BACKGROUND

1. Field of the Invention

The present application relates generally to hearing aids and, more particularly, to minimizing whistle noises caused by hearing aids.

2. Description of Related Art

Hearing aids are electroacoustic devices designed to amplify sound for the wearer, predominantly with the aim of making speech more intelligible, and to correct impaired hearing. Some of the earliest types of hearing aids were hearing trumpets. Over the years, more sophisticated types of hearing aids have been developed, such as: behind the ear (BTE), in the ear (ITE), in the canal (ITC), and body worn aids to name a few. Each of these generally involve a type of circuitry to amplify sound. Acoustic feedback can be a relatively common issue with more modern types of hearing aids.

Whistling from acoustic feedback can be caused by poor and loose fitting ear hearing aids as well as from inaccurate molds causing improper sizing of the hearing aid or misalignment of the hearing aid within the ear canal. A loose fit may develop over time as weight changes or through micro widening and loosening of the tissues of the ear canal with age. Whistling may also be experienced during selected activities where the hearing aid is more prone to shifting and motion. For example, activities that may cause loosening of the hearing aid may be sports, gymnastics, or other physical activities. Crude remedies for loose fit are strips of foam with an adhesive backing, dental strips with adhesive, lotion, putty, and so forth. Often, such remedies are insufficient, providing possibly only a temporary solution. Therefore, a new hearing aid is often the recommended solution resulting in extra costs to the user.

Although great strides have been made in hearing aids, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
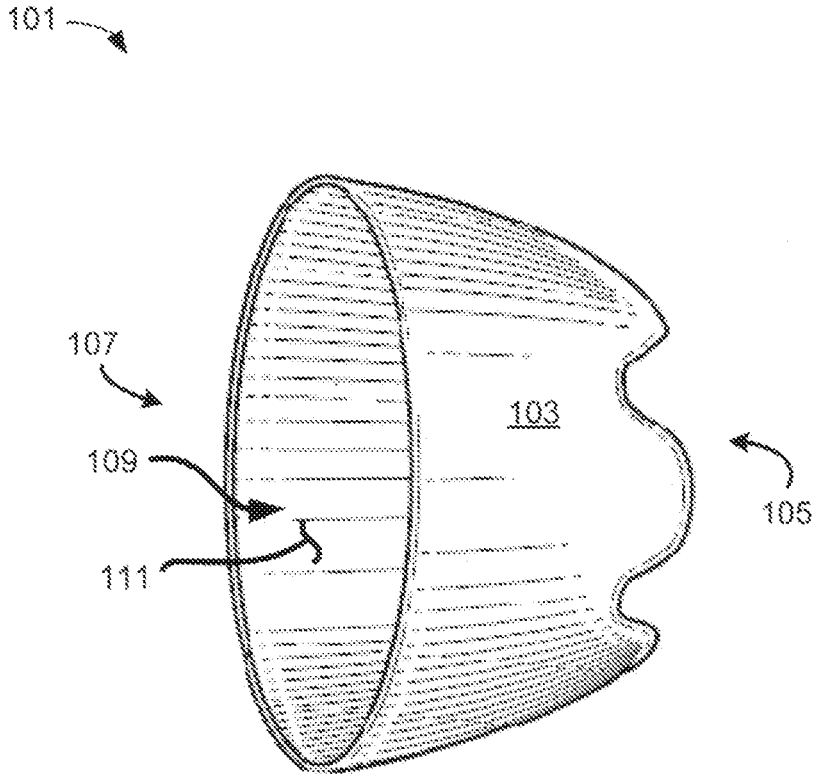
FIG. 1 is a perspective view of a hearing aid sleeve according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 2:
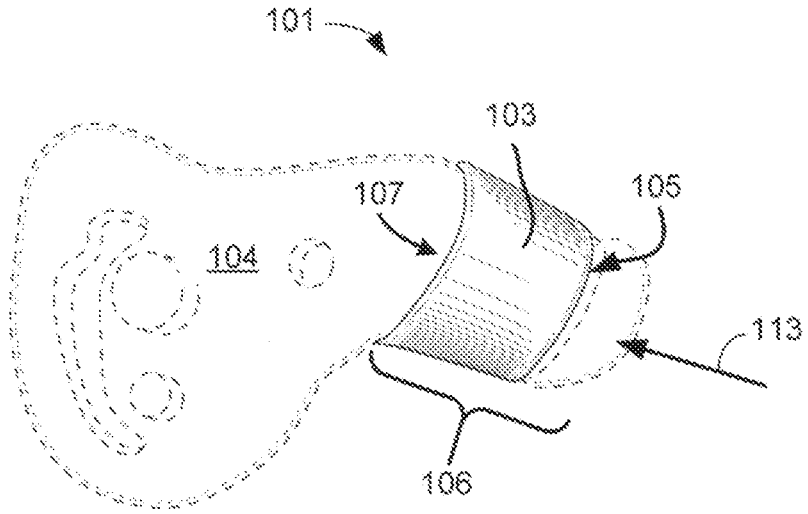
FIG. 2 is a perspective view of the hearing aid sleeve of FIG. 1 coupled to a hearing aid.

Referring now to FIGS. 1 and 2 in the drawings, a hearing aid sleeve is illustrated. Hearing aid sleeve 101 is configured to minimize acoustic feedback in hearing aids located within the ear canal. Hearing aid sleeve 101 includes a body 103 having a first end 105 and a second end 107, and an elongated aperture 109. Body 103 is made from a soft rubber material that is pliable and configured to flex to the contours of the inner ear canal. The rubber material of body 103 is non-allergenic to prevent inner ear itching. First end 105 is sized having a first diameter while the second end 107 is sized having a second diameter. The second diameter is larger than the first diameter so as to form a tapered contour in body 103. The tapered contour eases insertion within the ear canal. Body 103 has a relatively cylindrical shape but may be contoured to adjust to specific ear canal shapes. Additionally, the shape or natural contour of body 103 is configured to correct alignment of the hearing aid within the ear canal so as to redirect the sound emitted from the hearing aid. Incorrect molds used to form hearing aids can be inaccurate or faulty in its dimensioning. By selectively choosing the proper contour of body 103, a proper alignment can be obtained without the need to take a second mold of the ear and saving the user the cost of a new hearing aid. Elongated aperture 109 extends internally through body 103 passing from the first end to the second end. Elongated aperture 109 has an inner surface 111 configured to contact hearing aid 104.

Sleeve 101 is configured to be coupled to hearing aid 104. Hearing aid 104 is an exemplary type of hearing aid for use with sleeve 101. It is understood that multiple types of hearing aids that are inserted within the ear canal may use sleeve 101 to adjust the fit of hearing aid 104 within the ear canal to minimize acoustic feedback. Hearing aid 104 has an ear canal portion 106, which is the portion of hearing aid 104 that is inserted within the ear canal. As the size of the ear canal changes in relation to the size of canal portion 106, hearing aid 104 becomes loose, thereby resulting in increased acoustic feedback.

Sleeve 101 may be either integrally formed with hearing aid 104 or may be formed as an interchangeable and releasable device. When releaseable, sleeve 101 is configured to translate upwards along canal portion 106 in the direction of arrow 113. Body 103 is configured to flex and stretch as it passes upward along canal portion 106, inner surface 111 conforming to the contour of canal portion 106. Body 103 is configured to grip hearing aid 104 to prevent relative motion between inner surface 111 and canal portion 106. The flexing of body 103 generates a compressive force applied to canal portion 106, that compressive force combined with the gripping texture of the rubber material secures sleeve 101 to hearing aid 104. To remove, a sufficient force is applied translate sleeve 101 off of canal portion 106. In other embodiments, sleeve 101 may be secured to canal portion 106 through the use of an adhesive applied directly to either inner surface 111 or hearing aid 104 along canal portion 106. Sleeve 101 is configured to be interchangeable for replacement or maintenance of sleeve 101 itself or hearing aid 104.

The material of sleeve 101 extends outward around the circumference of canal portion 106 allowing sleeve 101 to seal fully to hearing aid 104. Additionally, by fully circumventing the perimeter of canal portion 106, sleeve 101 is more easily able to grip the ear canal. Use of sleeve 101 on hearing aid 104 greatly increases the longevity and comfort of hearing aid 104. Sleeve 101 allows a single hearing aid to be used on a single individual as the dimensions of the inner ear canal fluctuate with age. Hearing aid 104 may be sized to a specific user's ear initially but over time may become too loose. Use of sleeve 101 flexes to accommodate size variations in the ear canal. Using sleeve 101 allows the user to maintain their current hearing aid for a longer period of time: saving the user money and preventing the disposal of good hearing aids.

It is understood that sleeve 101 is configured to increase the diameter of canal portion 106 and then flex and compress to automatically adjust to the contour and sizing of the user's ear canal. The thickness of body 103 is predetermined by a user. A sleeve having one thickness may be interchanged with a second sleeve having a second thickness. Another feature of sleeve 101 is the ability of body 103 to remain undetected to external observers when inserted into the ear canal. Coloring of sleeve 101 is also customizable to match that of hearing aid 104 or to contrast that of hearing aid 104.

The current application has many advantages over the prior art including the following: (1) an interchangeable and releasable sleeve; (2) the ability of the hearing aid to adjust automatically to size changes in the ear canal; (3) minimization if not removal of whistling noises.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A hearing aid sleeve used to minimize acoustic feedback in loose fit hearing aids located within an ear canal, comprising:

a pliable rubber body configured to flex to the contours of the ear canal when compressed between the ear canal and the hearing aids, the rubber body having an outer surface configured to grip and mold to the contour of the ear canal;

a first end having a first diameter;

a second end having a second diameter, the second diameter being larger than the first diameter thereby forming a tapered contour; and an elongated aperture extending internally from the first end to the second end, the elongated aperture having an internal surface configured to contact the hearing aid, the hearing aid sleeve isolated to an ear canal portion of the hearing aid so as to have the hearing aid protrude from both ends of the hearing aid sleeve, the internal surface bonded to the hearing aid through the use of an adhesive; wherein outer surface is configured to flex and mold to the contour of the ear canal.

2. The hearing aid sleeve of claim 1, wherein the body is non-allergenic.

3. The hearing aid sleeve of claim 1, wherein the inner surface of the body is configured to grip the hearing aid to prevent relative motion between the inner surface and the hearing aid.

4. The hearing aid sleeve of claim 1, wherein the body is integrally formed into the hearing aid.

5. The hearing aid sleeve of claim 1, wherein the body is releasable and interchangeable.

6. The hearing aid sleeve of claim 1, wherein the body is configured to correct alignment of the hearing aid within the ear canal.

7. A method of minimizing acoustic feedback in loose fitting hearing aids located within an ear canal, comprising:

obtaining a hearing aid configured to operate within the ear canal; and applying an adhesive directly to an ear canal portion of the hearing aid;

coupling a hearing aid sleeve to a canal end of the hearing aid, the hearing aid sleeve being restricted to the canal end of the hearing aid, the hearing aid sleeve having:

a pliable rubber body configured to flex when compressed between the ear canal and the hearing aid, the rubber body having an outer surface configured to grip and mold to the contour of the ear canal; and an elongated aperture extending internally from the first end to the second end, the elongated aperture having an internal surface configured to contact the hearing aid, the hearing aid protruding from both ends of the hearing aid sleeve; wherein compression of the pliable rubber body within the ear canal secures the position and orientation of the hearing aid within the ear canal.

8. The method of claim 7, wherein the body is non-allergenic.

9. The method of claim 7, wherein the pliable body is secured to the hearing aid through a compressive force from generated from the flexing of the pliable body.

10. The method of claim 7, wherein the pliable body is integrally formed into the hearing aid.

11. The method of claim 7, wherein the pliable body is releasable and interchangeable.

12. The method of claim 7, further comprising:

adjusting the alignment of the hearing aid within the ear canal by changing the contour of the body.

* * * * *